US005548953A

United States Patent [19]

Hedges et al.

[11] Patent Number: 5,548,953

[45] Date of Patent: Aug. 27, 1996

[54] CARBON-CARBON GRID ELEMENTS FOR ION THRUSTER ION OPTICS

[75] Inventors: Daniel E. Hedges, Seattle; Jere S. Meserole, Jr., Issaquah; Michael E. Rorabaugh, Seattle, all of Wash.

[73] Assignee: The Boeing Company, Seattle, Wash.

[21] Appl. No.: 303,094

[22] Filed: Sep. 8, 1994

Related U.S. Application Data

[63] Continuation-in-part of Ser. No. 23,285, Feb. 26, 1993.

[51] Int. Cl.[6] ..... F03H 1/00

[52] U.S. Cl. ..... 60/202

[58] Field of Search ..... 60/202, 203.1; 313/293, 299, 334, 348, 352, 359.1, 360.1, 361.1

[56] References Cited

U.S. PATENT DOCUMENTS

| | | | |
|---|---|---|---|
| 2,926,251 | 2/1960 | Luce et al. . | |
| 3,632,460 | 1/1972 | Palfreyman . | |
| 4,104,875 | 8/1978 | Birner et al. . | |
| 4,137,477 | 1/1979 | Krol et al. | 313/348 |
| 4,229,674 | 10/1980 | Hoet | 313/348 |
| 4,469,984 | 9/1984 | Sergeev et al. | 313/348 |
| 4,825,646 | 5/1989 | Challoner et al. . | |
| 5,225,296 | 7/1993 | Ohsawa et al. | 429/218 |

OTHER PUBLICATIONS

Brophy, et al., "Ion Engine Endurance Testing At High Background Pressures", AIAA/SAE/ASME/ASEE 28th Joint Propulsion Conference and Exhibit, Jul. 6–8, 1992, Nashville, TN, AIAA–92–3205 (20 pp.).

Garner, et al., "Fabrication and Testing of Carbon–Carbon Grids for Ion Optics", AIAA/SAE/ASME/ASEE, 28th Joint Propulsion Conference and Exhibit, Jul. 6–8, 1992, Nashville, TN, AIAA–92–3149 (12 pp.).

Garner, "Carbon–Carbon Grids for Ion Engines," JPL 19174, NPO–19174–1–CU, Jul. 6, 1993 [available from NTIS or NASA].

*Primary Examiner*—Louis J. Casaregola
*Attorney, Agent, or Firm*—John C. Hammar

[57] ABSTRACT

Carbon-carbon grids for ion optics sets are thermomechanically stable under the extreme temperature changes that are experienced in ion thrusters. Screen, accelerator and decelerator grids are thermomechanically stable, lightweight, and resistant to erosion from ion sputtering and have extended lifetimes over conventional molybdenum grids.

8 Claims, 12 Drawing Sheets

CARBON-CARBON GRID ELEMENTS FOR ION THRUSTER ION OPTICS

REFERENCE TO RELATED APPLICATIONS

This application is a continuation-in-part application based upon U.S. patent application Ser. No. 08/023,285, filed Feb. 26, 1993, which we incorporate by reference.

FIELD OF THE INVENTION

The present invention relates to an ion optics set for an ion beam source, particularly ion beam sources for space propulsion, such as ion thrusters.

BACKGROUND OF THE INVENTION

Space propulsion, surface cleaning, ion implantation, and high energy accelerators use two or three closely spaced multiple-aperture electrodes to extractions from a source and eject them in a collimated beam. The electrodes are called "grids" because they are perforated with a large number of small holes in a regular array. Typically, the grids are made from molybdenum. A series of grids constitute an "ion optics" electrostatic ion accelerator and focusing system.

Ion beam sources designed for spacecraft propulsion, that is, ion thrusters, should have long lifetimes (10,000 hours or more), be efficient, and be lightweight. These factors can be important in other applications as well, but, for ion thrusters, they are critical. Ion thrusters have been successfully tested in space, and show promise for significant savings in propellant because of their high specific impulse (an order of magnitude higher than that of chemical rocket engines). They have yet to achieve any significant space use, however, because of lifetime limitations resulting from grid erosion and performance constraints resulting from thermal-mechanical design considerations, particularly the spacing of metallic grids, including molybdenum. We have discovered a way to extend the lifetime dramatically.

In an electron bombardment ion thruster, a cathode produces electrons that strike neutral gas atoms introduced through a propellant feed line. The electrons ionize the gas propellant and produce a diffuse plasma. In a radio frequency ion thruster, the propellant is ionized electromagnetically by an external coil, and there is no cathode. In both cases, an anode associated with the plasma raises its positive potential. To maintain the positive potential of the anode, a power supply pumps to ground potential some of the electrons that the anode collects from the plasma. These electrons are ejected into space by a neutralizer to neutralize the ion beam. Magnets act to inhibit electrons and ions from leaving the plasma. Ions drift toward the ion optics, and enter the holes in a screen grid. A voltage difference between the screen grid and an accelerator grid accelerates the ions, thereby creating thrust. The screen grid is at the plasma potential, and the accelerator grid is held at a negative potential to prevent downstream electrons from entering the thruster. Optionally, the optics can include a decelerator grid located slightly downstream of the accelerator grid and held at ground potential or at a lesser negative potential than the accelerator grid to improve beam focusing and reduce ion impingement on the negative accelerator grid.

Ion impact erosion of the ion optics (i.e., the grids) is the primary mechanism limiting the life of ion thrusters. In ion thrusters, slow moving ions are produced within and downstream of the ion optics by a charge exchange (i.e., electron hopping) from neutral propellant atoms to fast moving ions that pass close by. These "charge exchange" ions are attracted to the accelerator grid and strike it at high energy, gradually eroding it. The screen grid also experiences some erosion, mostly on the upstream side but generally only from plasma ions. The erosion of the accelerator grid eventually weakens it to the point that the grid fails and breaks.

A principal factor affecting both the efficiency and the weight of ion thrusters is how closely and precisely the grids can be positioned while maintaining relative uniformity in the grid-to-grid spacing at high operating temperatures or in conditions where the spatial temperature is nonuniform and thermal distortion can occur because of temperature gradients. In the past, this factor has limited the maximum practical diameter of ion thrusters, which severely constrains taking advantage of scale effects (that theoretically would improve efficiency), thrust-to-weight ratio, and reliability.

Molybdenum ion thruster grids are precisely hydroformed into matching convex shapes. The apertures are chemically etched in the formed sheets. The convex shapes provide a predictable direction for the deformation that occurs due to thermal expansion when a thruster heats in operation. Changes in the actual spacing and the uniformity of spacing over the grid surfaces between the molybdenum grids is unpredictable and uncontrollable. The thermal expansion distribution is complex.

The changes in spacing that occur adversely effect performance. Although techniques have been developed to compensate for such changes, the unpredictable and nonuniform nature of the changes prevents complete compensation.

In ion beam sources used for terrestrial applications, today's grids are sometimes made of graphite, which expands much less than molybdenum when heated. Graphite is, however, relatively flexible and fragile and is unsuitable for beam sources larger than about 15–20 cm in diameter, or for space applications where the ion thruster grids are subject to severe vibration during launch from Earth.

It is desirable to have a screen grid and accelerator grid that have lifetimes of 10,000 to 20,000 hours for use in a variety of space propulsion applications. Such grids should also have improved efficiency and should be lightweight. Additionally, the screen grids of an ion optics set should allow for precise prediction of the magnitude and uniformity of the spacing between the grids. The goal is to maintain the spacing over the temperature range and pattern of differential surface temperature that the grids experience.

SUMMARY OF THE INVENTION

The present invention relates to an ion thruster having improved performance arising from using screen grids and accelerator grids made of carbon-carbon composite material. Carbon-carbon grids are lightweight and resistant to erosion. Carbon-carbon composite material can have a coefficient of thermal expansion of essentially zero. Heat effects on the carbon-carbon grids, therefore, are negligible. The grids maintain their relative spacing across the range of operating temperatures. They also maintain their shape against differential surface temperatures, and a temperature gradient across the grids has no significant effect. In another aspect, the present invention relates to a process for producing grids made of carbon-carbon composite material.

A feature of the present invention is a grid element in an ion optics set for use in an ion beam source, including a body having a plurality of apertures. The body is a carbon-carbon composite comprising carbon fibers embedded in a carbon matrix. Each grid element can either be a screen, accelerator or decelerator grid in the optics set.

In another aspect, the present invention relates to a process for manufacturing a carbon-carbon composite grid element for an ion beam source. The process includes the steps of positioning a plurality of carbon fibers in a crossed or woven array. This array of carbon fibers is then embedded in a carbon matrix. We can fabricate apertures in the array during the positioning of the fibers, or cut them after the fibers are embedded in the matrix.

In yet another aspect, the present invention is an ion optics set that includes a carbon-carbon screen grid and a carbon-carbon accelerator grid. Because thermal expansion of the grids is negligible or nonexistent, the ion optics set made from our carbon-carbon grids can include a narrow gap, (i.e., closer spacing than metallic grids permit) which will remain substantially constant during operation. This accurately controlled gap provides improved performance.

It is important that the apertures between grids be precisely aligned and that they remain aligned. Otherwise, accelerated ions are directed into the next grid or are ejected at an angle that diverges from the desired axial direction. The resulting thrust vector from the misdirected ions is smaller than optimal, and the ion beam is not collimated. Carbon-carbon grids maintain this precise alignment of holes from grid to grid, and, thereby, optimize the thrust.

DETAILED DESCRIPTION OF THE PREFERRED EMBODIMENT

Figure 1:
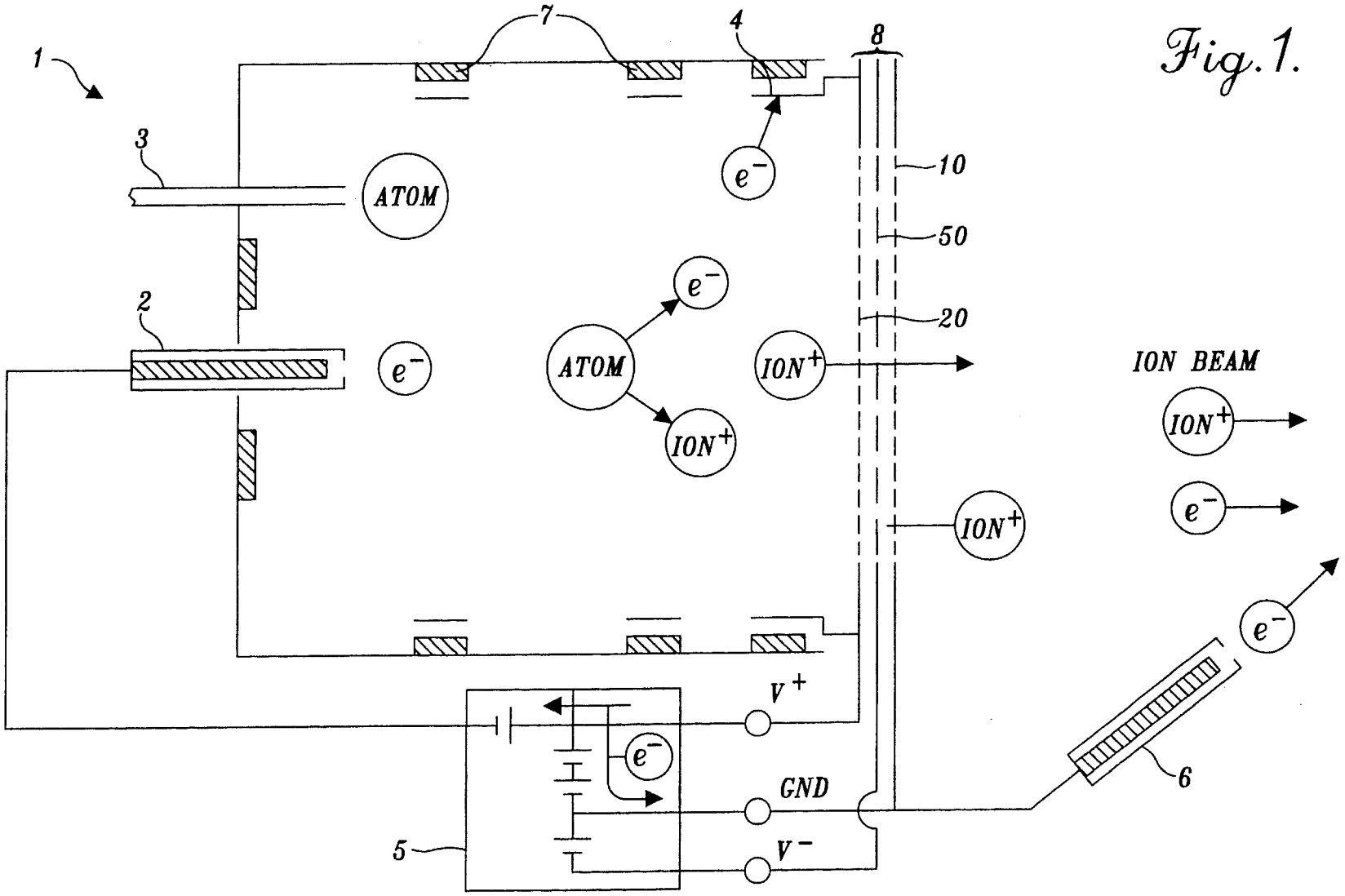
FIG. 1 is a schematic diagram of an ion thruster constructed in accordance with the present invention.

The present invention is described in the context of an ion thruster 1, shown schematically in FIG. 1. This type of thruster is referred to as an electron-bombardment ion thruster, and includes a cathode 2, propellant feedline 3, anode 4, power supply 5, neutralizer 6, magnet 7, and ion optics 8. The general operation of an ion thruster is described in the Background of the Invention and is not repeated here. Additional details regarding ion thrusters, and particularly ion optics 8, are set forth in Meserole, *Measurement of Relative Erosion Rates of Carbon-Carbon and Molybdenum Ion Optics,* 30th AIAA/ASE/SAE/ASEE Joint Prop. Conf., Jun. 27–29, 1994, pp. 1–9, Hedges and Meserole, *Demonstration and Evaluation of Carbon-Carbon Ion Optics*, JOURNAL OF PROPULSION & POWER, March–April 1994; Meserole & Hedges, *Comparison Of Erosion Rates of Carbon-Carbon and Molybdenum Ion Optics,* 23rd Int'l Electric Prop. Conf. (IEPC-93-111), Sept. 13–16, 1993, pp. 1–9; Garner and Brophy, *Fabrication and Testing of Carbon-Carbon Grills for Ion Optics*, AIAA, 92–3149 (1992); and Garner, Carbon-Carbon Grid for Ion Engines, NTIS Document NPO-19174-1-CU [U.S. patent application Ser. No. 08/089,064 filed Jul. 1, 1993]which we incorporate by reference.

Figure 2:
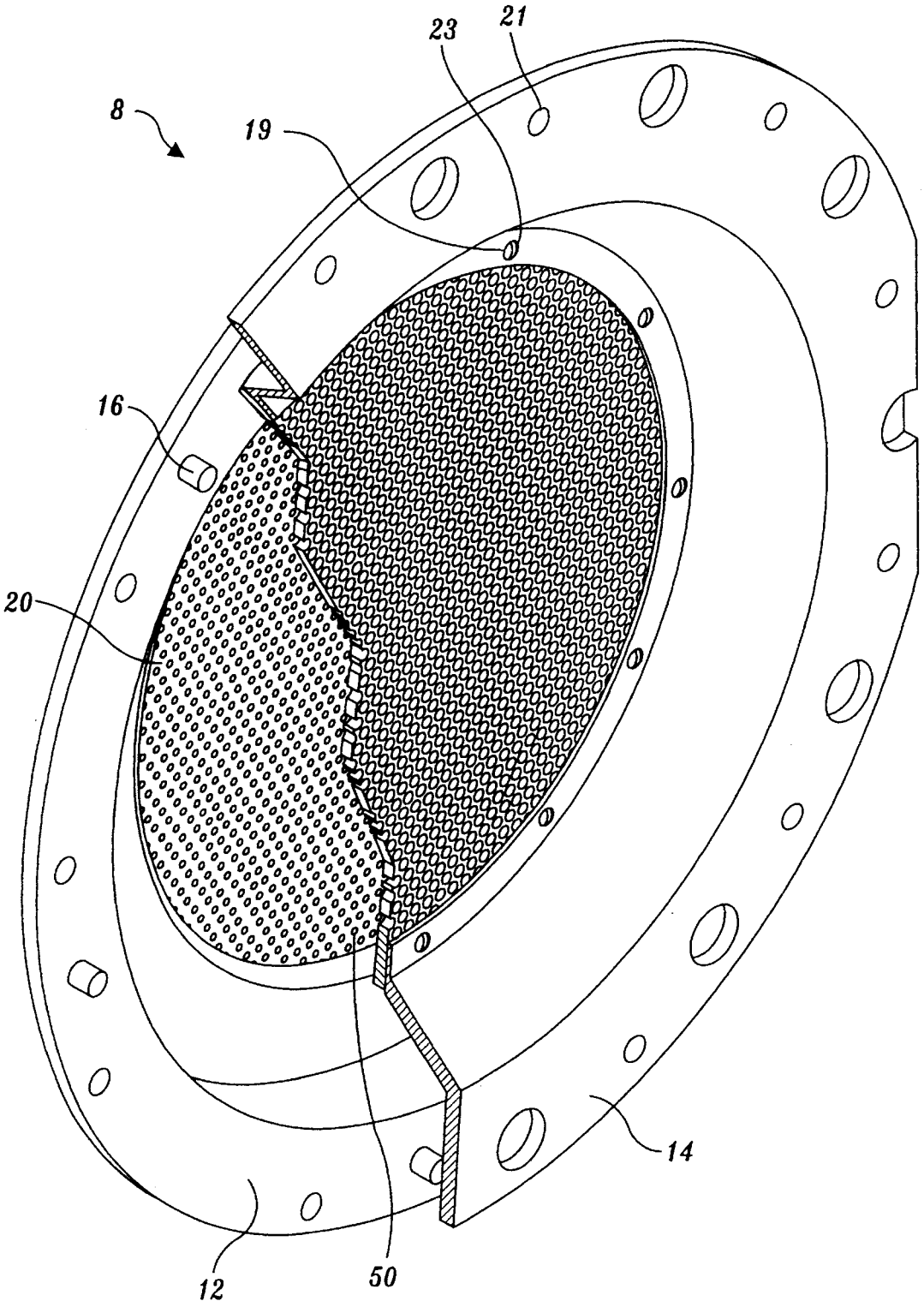
FIG. 2 is an illustration of ion optics grids and mounting rings included in the thruster of FIG. 1.

Referring now to FIG. 2, the ion optics set 8 is shown in greater detail as including a screen grid 20 and an accelerator grid 50. An optional decelerator grid 10 is shown in FIG. 1 but not FIG. 2. Screen grid 20 and accelerator grid 50 are secured to the frame of the ion thruster (not shown) by annular dish-shaped mounting rings 12 and 14, respectively, whose spacing is controlled by spacers 16. The benefits and advantages of the present invention also apply to ion beam sources that are used for applications other than ion thrusters.

Figure 10:
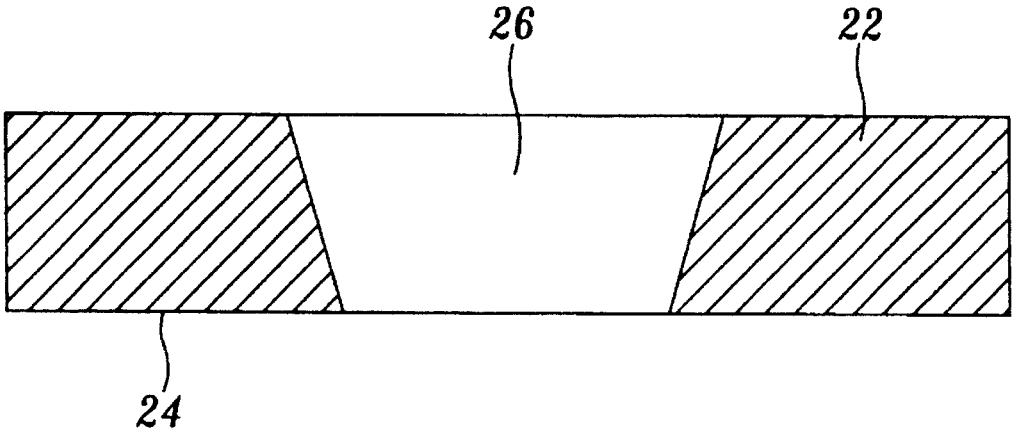
FIG. 10 is an elevational view of a cross section of an aperture in the screen grid of FIG. 2.

In the embodiment shown in FIG. 2, the screen grid 20 is a substantially planar element that is a carbon-carbon composite comprising a carbon fiber array embedded in a carbon matrix. Referring additionally to FIG. 10, screen grid 20 includes an entry plane 22 and an opposing exit plane 24. Entry plane 22 and exit plane 24 are substantially parallel which provides a screen grid of substantially uniform thickness. In the illustrated embodiment, screen grid 20 has a thickness on the order of about 0.8 millimeters (mm) and includes an array of apertures 26. Each array is approximately 10 centimeters (cm) in diameter. These dimensions are illustrative only; we can use different diameters and thicknesses. For ion thrusters, we prefer the grids thinner, e.g., on the order of 0.3–0.4 mm, and larger in diameter, e.g., up to 50 cm or more, if possible. We prefer thinner grids from the standpoint of increasing the electric field strength. Thickness is important from handling, assembly, and lifetime viewpoints, but the goal is to make the grids as thin as possible while retaining stiffness, uniformity, and the other required assembly properties. The accelerator grid generally can be the same thickness or slightly thicker than the screen grid on the order of 0.5–1.0 min. Carbon-carbon grids allows us to make the accelerator grid thicker where processing constraints for metal grids limit them generally to being the same thickness.

Figure 3:
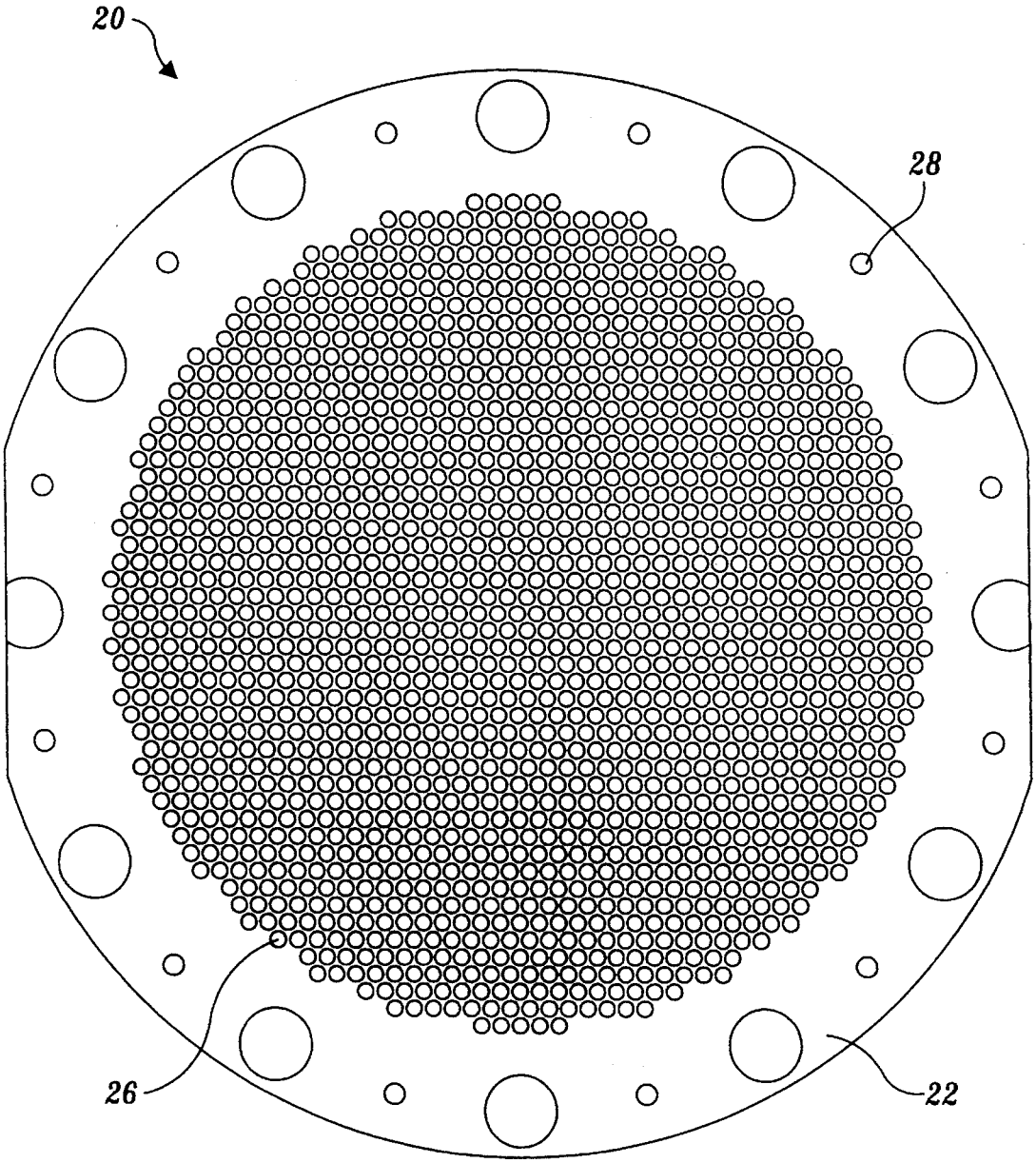
FIG. 3 is a top plan view of a screen grid.

Adjacent the periphery of screen grid 20 are a plurality of equally spaced mounting holes 28, shown in FIG. 3, that extend through screen grid 20 from entry plane 22 to exit plane 24. The central portion of screen grid 20 includes a plurality of round apertures 26 that extend through screen grid 20 from entry plane 22 to exit plane 24. As shown in FIG. 10, apertures 26 have a diameter at entry plane 22 that is greater than the diameter at exit plane 24. In this manner, apertures 26 have a vertical profile that narrows from entry plane 22 to exit plane 24 that is, they taper from inlet to outlet. The taper is about 6° and arises from laser cutting of the holes. In the illustrated embodiment, screen grid 20 includes approximately 1,600 apertures of essentially the same size and shape having a hole diameter of approximately 1.83 mm. The open area fraction through illustrated screen grid 20, then, is about 0.59. The spacing between the center points of adjacent apertures 26 is approximately 2.29 mm. The nominal open area fraction for our preferred screen grids is on the order of 0.67 with a range, typically of about 0.65–0.80. Size of the apertures, their shape, and their spacing, of course, can change. In fact, the size of the apertures may vary from the center of the grid to the edges to tailor the beam. In the illustrated embodiment, apertures 26 in screen grid 20 are arranged in a hexagonal array. The hexagonal array provides an aperture at the center of a hexagon with other apertures centered on the intersection of the six sides of a hexagon. Such hexagonal array is more clearly illustrated in FIG. 7, which is a magnified view of a portion of entry plane 22 of screen grid 20.

Figure 6:
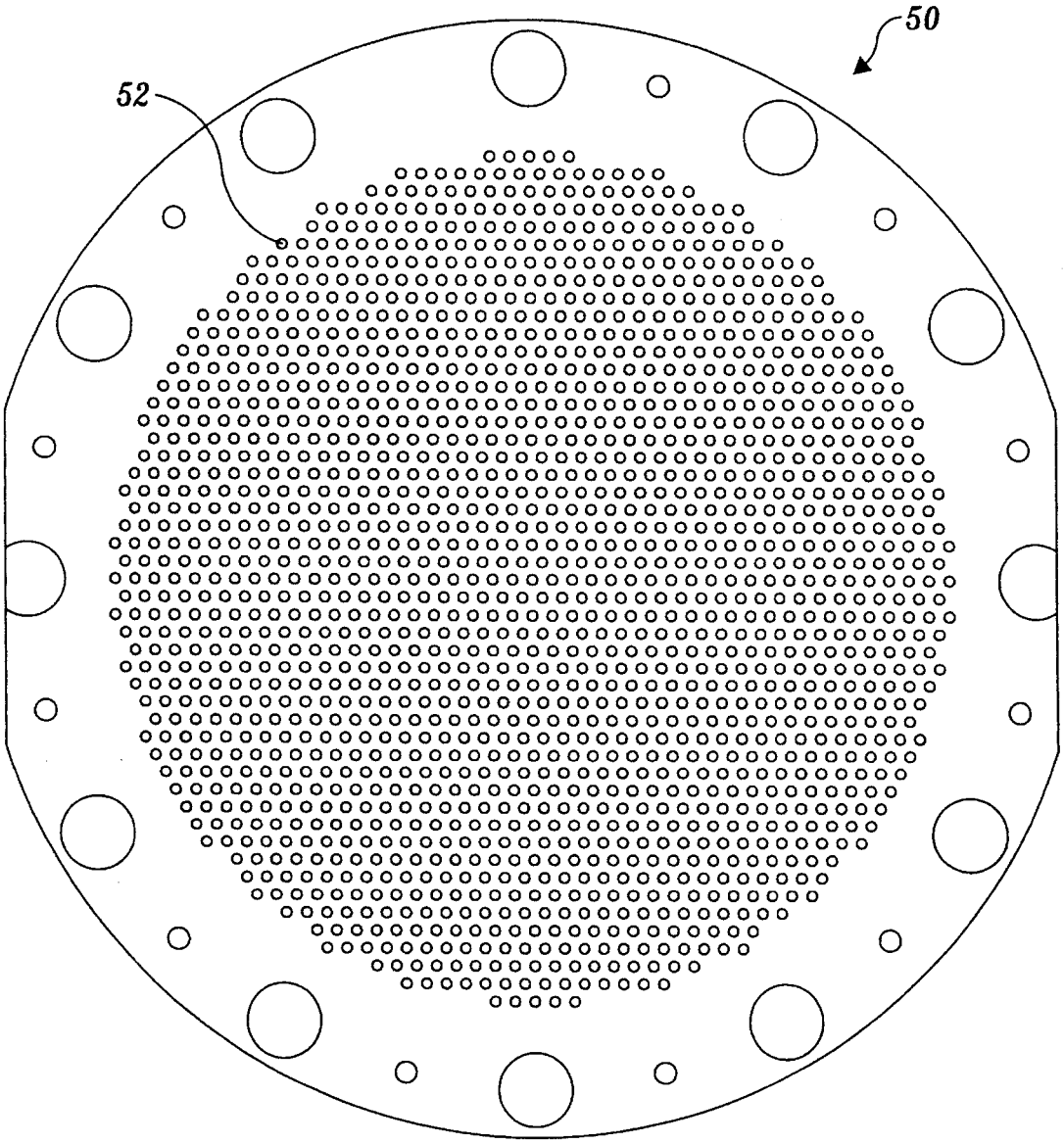
FIG. 6 is a top plan view of an accelerator grid.
Figure 7:
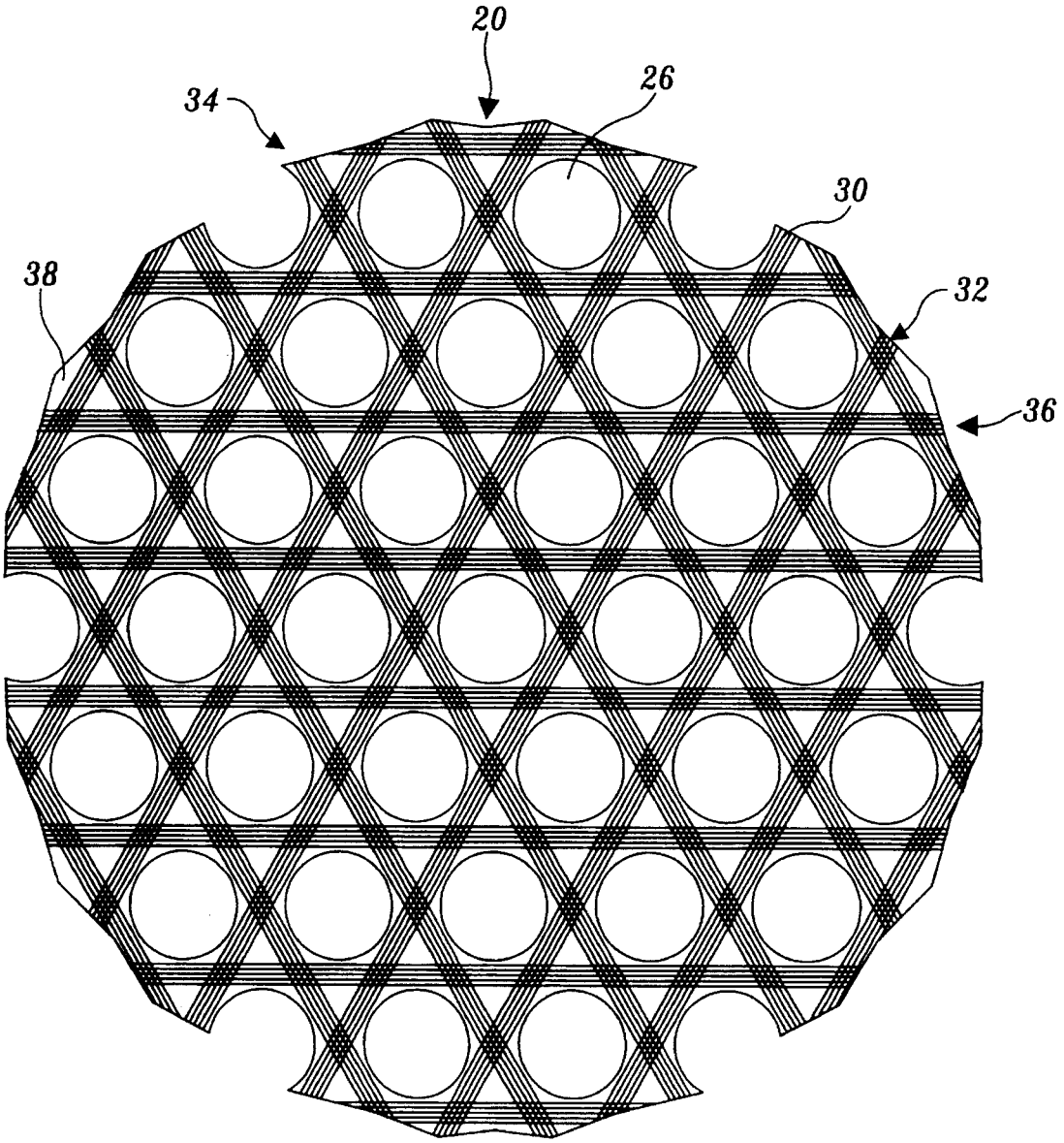
FIG. 7 is an enlarged top plan view of a portion of the screen grid of FIG. 1.
Figure 8:
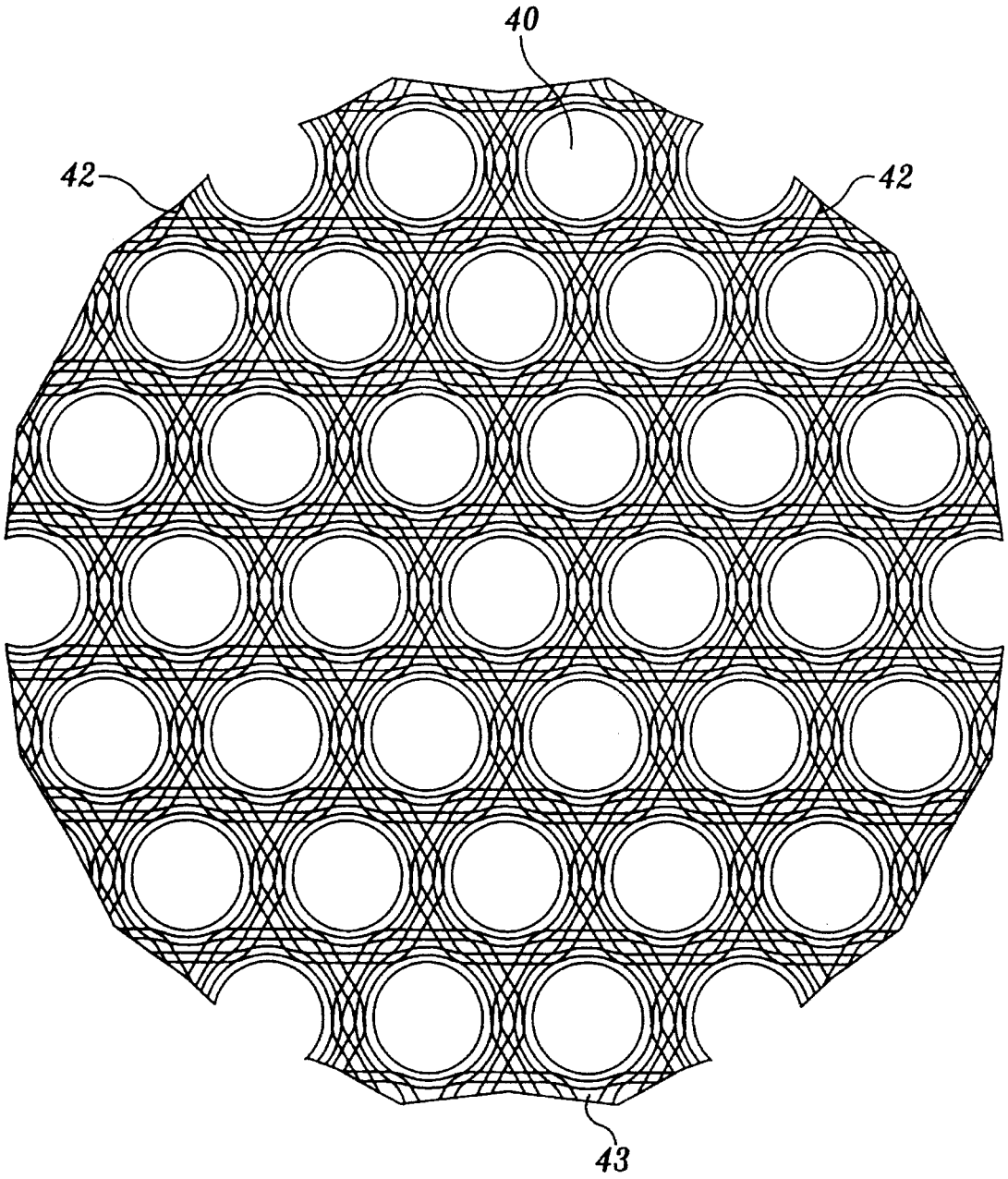
FIG. 8 is an enlarged top plan view of a portion of another screen grid.

Referring to FIG. 7, screen grid 20 includes carbon fibers 30 arranged in an array between apertures 26 and carbon matrix 38 that is infiltrated into the array. In the illustrated embodiment, carbon fibers 30 are arranged parallel to three different axes. Sets of carbon fibers 30 are arranged parallel to a first axis 32. Other carbon fibers 30 are arranged parallel to a second axis 34 which is offset or rotated from axis 32 by 60°. Similarly, axis 36 is rotated 60° from axis 34. In the illustrated embodiment, spacing between the periphery of apertures 26 is large enough that carbon fibers 30 can extend in a straight line from edge to edge of screen grid 20. When apertures 26 are larger and the carbon fibers cannot be run in a straight run from edge to edge, the carbon fibers can be "snaked" around the apertures, as shown in FIG. 8, where screen grid 20 includes fibers 42, carbon matrix 43, and apertures 40 that are larger diameter than apertures 26 illustrated in FIGS. 2 and 6. As noted above, when apertures 40 attain a certain diameter, carbon fibers 42 cannot extend in a straight line from edge to edge of screen grid 20. To achieve this "snaking" of the carbon fibers, we lay up the array up on a pattern of pegs or inserts (i.e., a formboard) where the pegs serve to define apertures 40.

It is also possible that in specific applications the size of the apertures passing through the screen grid will make it possible to have some fibers run in a straight line between the edges of the screen grid and other fibers that "snake" around the apertures.

Figure 4:
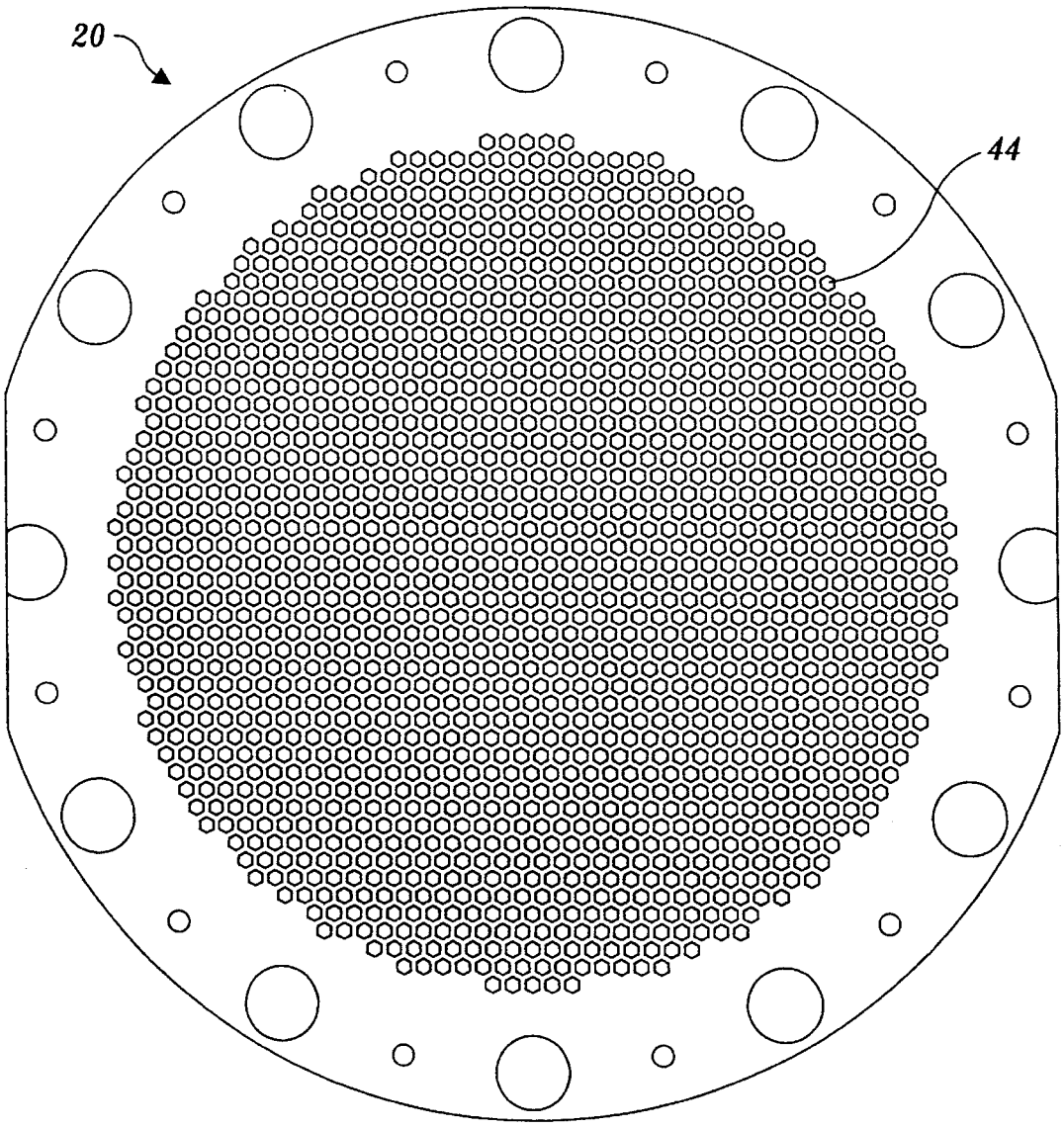
FIG. 4 is a plan view of the top of a second embodiment of a screen grid.

Referring to FIG. 4, another embodiment of screen grid 20 has hexagonal apertures 44 arranged in a hexagonal array. Depending on the dimensions of hexagonal apertures 44, carbon fibers can extend from edge to edge of the screen grid in a straight line or they may be "snaked" around hexagonal apertures 44 as described above. Under certain operating conditions, hexagonal holes may provide slightly better thruster performance than round holes.

Figure 5:
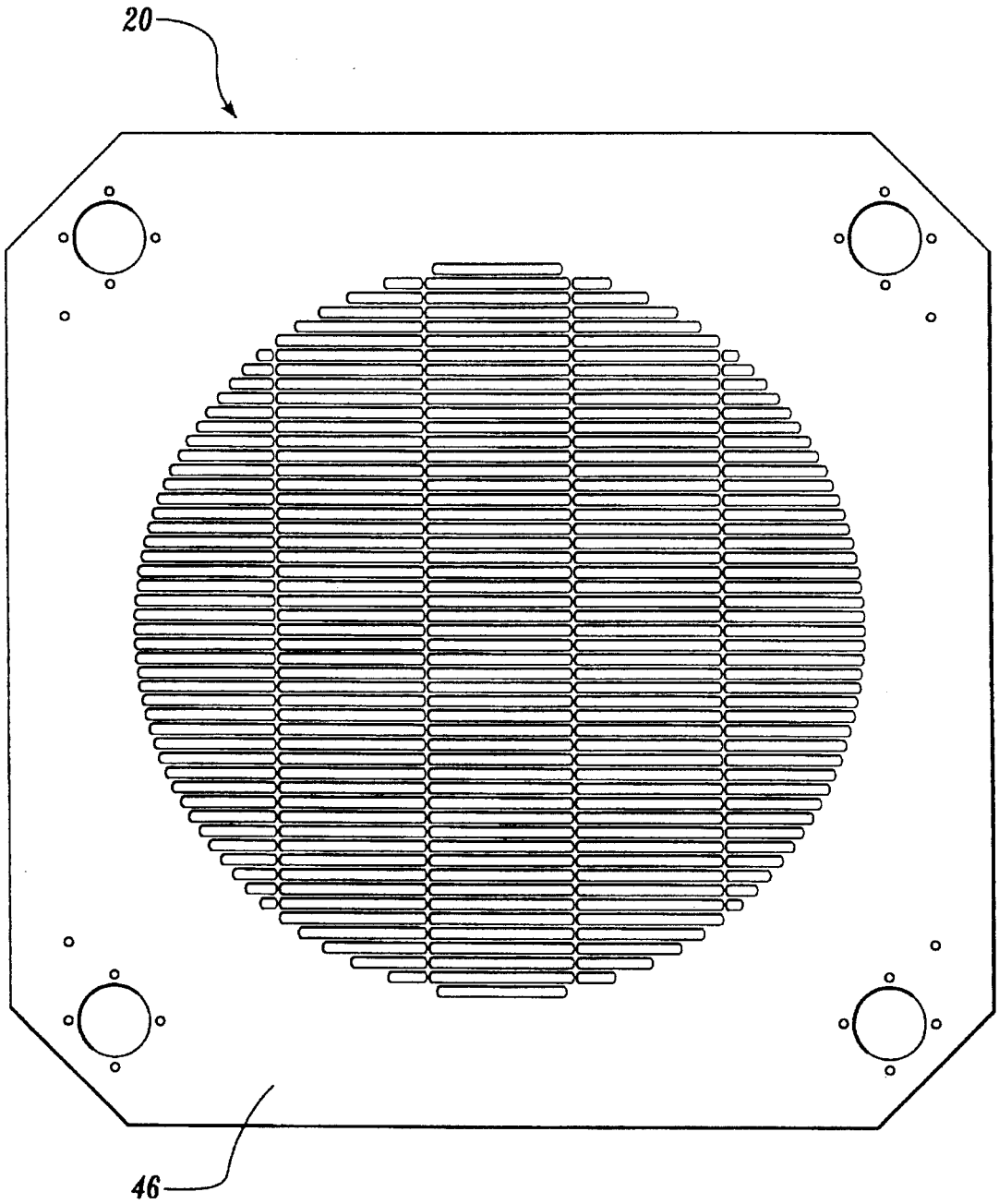
FIG. 5 is a top plan view of a third embodiment of a screen grid.
Figure 9:
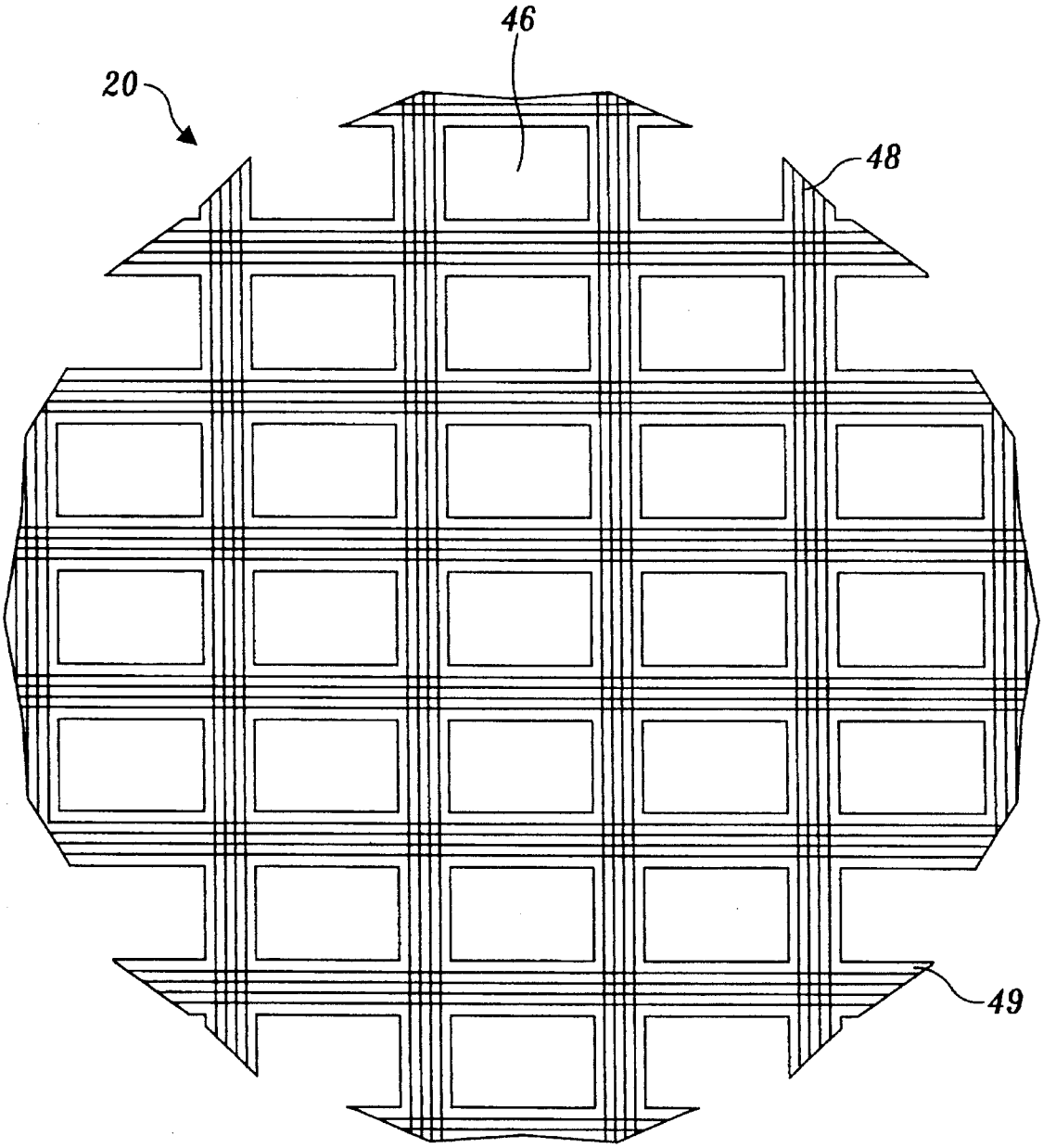
FIG. 9 is an enlarged plan view of a portion of a typical screen grid showing the reinforcing fibers between apertures.

Referring to FIG. 5, another embodiment of screen grid 20 has generally rectangular apertures 46 arranged in orthogonal rows and columns or any other suitable arrangement. Rectangles near the edges are shortened to achieve the overall circular design. When apertures 46 are arranged in orthogonal rows and columns, carbon fibers 48 infiltrated with carbon matrix 49 extend in straight lines (FIG. 9) from edge to edge of the screen grid in an orthogonal array. This arrangement offers the advantage of providing orthogonal straight paths for the fibers across the entire grid, thereby maximizing the grid's stiffness. A typical rectangle for a screen grid has a length of about 29.80 mm and a width of about 2.00 mm. A typical rectangle for an accelerator grid has a length of about 29.50 mm and a width of about 0.72 mm. The rectangles actually are distended in the form of ovals or similar shapes where the width near the edges may exceed slightly the width near the center. The carbon-carbon spacing between rectangles is about 0.95 mm wide in this design.

As an alternative to arranging individual carbon fibers or tows of carbon fibers in the arrays described above, we can arrange pre-woven sheets of carbon fibers in layers to provide the needed carbon fiber array. When we use sheets of woven carbon fibers, we arrange the sheets in layers that are offset (for example by 60°) from each other with respect to the direction of the weave or in any other suitable pattern. We prefer pre-woven sheets of carbon fibers over the individual tows of fibers from an ease of handling perspective; however, the pre-woven sheets are generally thicker than the individual fibers or tows and therefore are not preferred from the standpoint of providing a thin grid.

Referring to FIG. 6, the accelerator grid 50 is substantially identical to screen grid 20 with the exception that the size of apertures 52 is smaller to restrict the flow of neutral atoms out of the thruster. The electric field between the screen grid and accelerator grid is shaped so as to focus the ions passing through the large screen grid apertures into and through the smaller accelerator grid apertures. For example, for screen grid 20 described with reference to FIG. 2, a counterpart accelerator grid could include apertures 52 having a diameter of about 1.09 min. The illustrated accelerator grid has an open area fraction of about 0.29, but we can alter the fraction in the range 0.2–0.3, and, preferably, 0.24–0.27. Thus, the range for the grids is on the order of 0.2–0.8. Accelerator grid 50 has substantially the same number of apertures 52 (usually precisely the same in an identical pattern) as the screen grid and when the two are combined to form an ion optics pair, we align the axes of the apertures of the screen grid and the axes of the apertures of the accelerator grid. If a decelerator grid is used, it also should have the same number and arrangement of apertures, with all three sets of apertures aligned in the ion optics set.

The screen grid and the accelerator grid can both include hexagonal apertures or rectangular apertures arranged in the same manner as described above, or other arrays suitable for the application. Rectangular apertures should have a length that is relatively large in comparison to the width. In the extreme, the rectangles become slits. Similarly, one could vary the size of apertures as a function of their position in the grids (i.e., center to edge) to match the distribution of plasma over the grids. Typically the plasma in the discharge chamber is less at the periphery than at the center.

To achieve the thinnest grids, we prefer to use unidirectional tape of carbon fibers laid up in just two directions, 90 deg/0 deg/0 deg/90 deg in four plies, yielding an array of rectangular apertures. Using tape, we have successfully made grids 0.4 mm thick. We would not use more than 8 plies in any event because of weight considerations. Tape holds the fiber tows in an organic resin without the thickness penalty that a woven fabric imposes, so we prefer tape for ease of handling and placement of the fibers. Tape provides a uniform fiber distribution and avoids the voids associated with woven fabric. Tape keeps the fibers straight, which provides increased stiffness.

The tape resin is a phenolic or other high char yield resin that, following pyrolysis, will leave the fibers permanently bonded in the desired arrangement. A fabric also typically includes a resin component that provides fiber-to-fiber bonding and, following pyrolysis, provides the first layer of the carbon matrix.

While we illustrate grids that have a circular periphery, other shapes will also work.

Figure 11:
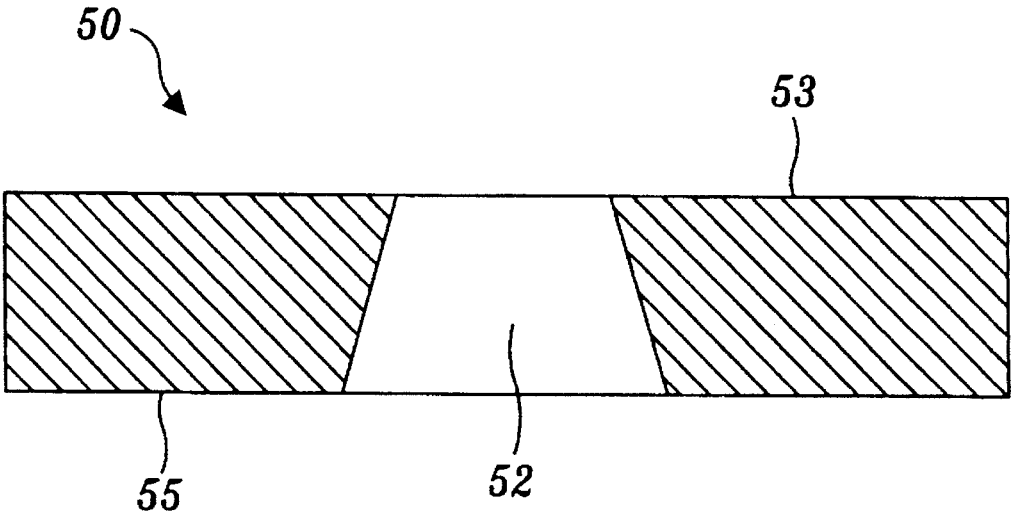
FIG. 11 is an elevational view of a cross section of an aperture in the accelerator grid of FIG. 6.

Referring to FIG. 11, as with the screen grids, accelerator grid 50 includes an entry plane 53 and an opposing exit plane 55. Entry plane 53 and exit plane 55, as with the screen grid, are substantially parallel so that the accelerator grid has a substantially uniform thickness. The diameter of aperture 52 at entry plane 53 is less than the diameter of aperture 52 at exit plane 55. In this manner, aperture 52 has a profile through accelerator grid 50 that is tapered from entry plane 53 to exit plane 55.

The carbon fibers that we use include those that are commercially available from a number of sources, including the K-1100 high modulus fiber available from Amoco or Gronoc XN-80A fibers from Nippon Oil Co. Such fibers are usually drawn and may be interwoven to provide tows or sheets of fibers. The fibers available exhibit a range of physical properties. For ion thrusters, fibers having an elastic modulus on the order of $4\times10^5$ MPa to $1\times10^6$ MPa and a diameter of about 10 micrometers are suitable. Carbon fibers having a high elastic modulus near the upper end of the range will generally allow thinner grids of adequate overall stiffness. We generally prefer stiffer fibers provided that they have commensurate strength so as not to be brittle and fragile during handling. Grids made with carbon fibers near the lower end of the range will require appropriate thermal processing after forming to increase the fiber modulus to a higher value, preferably above (100 million psi) $7\times10^5$ MPa.

A carbon matrix is built around the carbon fiber array by a repetitive process involving infiltration of a carbonaceous material followed by high-temperature pyrolysis. The carbonaceous materials can be pitch, resin, organic gases, or a combination of these materials, although only one material typically is used in any given infiltration and pyrolysis sequence. Pyrolysis is a thermal process which decomposes the carbonaceous precursor material to leave a residue of pure carbon as the carbon matrix around the carbon fiber array. The process of building the carbon matrix is referred to as densification because the density is increased as fibers become embedded in the carbon matrix.

Organic gas infiltration, otherwise known as chemical vapor infiltration, is generally carried out in a controlled atmosphere furnace where an organic gas infiltrates the carbon fiber array, decomposes at the surfaces, and leaves a carbon residue which binds the fibers together and forms a continuous matrix. B. F. Goodrich of Sante Fe Springs, Calif. provides chemical vapor infiltration services.

Although the described screen, accelerator, and decelerator grids are planar, it may be desirable to curve the grid a small amount in certain applications to add stiffness.

As noted previously, the screen grid 20 and accelerator grid 50 are coupled to the frame of the ion thruster by carbon-carbon mounting rings 12 and 14. A greater variety of fiber arrays can also be used in rings 12 and 14, given the absence of the grid apertures. Each ring includes a central opening 18 dimensioned to enclose the aperture region of the grid it is used with. Each ring includes a plurality of grid mounting holes 19 and frame mounting holes 21. The mounting rings 12 and 14 are attached to grids 20 and 50 via the grid mounting holes 19 and mounting screws 23. The rings are also attached to the thruster frame by screws (not shown). We use alignment pins to achieve the desired relative alignment of these various components.

The carbon-carbon grids and mounting rings do not expand upon heating. In fact, they might contract, but only slightly. Their coefficient of thermal expansion is essentially zero. Since expansion of the grids and mounting rings is negligible over the operational temperature gradients, which can be on the order of 350 degrees Celsius, we can maintain better alignment of the apertures and a constant spacing between the screen grid and the accelerator grids. When spacing between the grids can be reliably maintained constant during the operational temperature changes, the grids can be spaced closer together without the risk that expansion will cause the grids to touch each other and be electrically shorted, or that the beam density will be excessive in one area of the grid over another where the gap is smaller than intended. Shorting destroys the voltage gradient needed to accelerate the ions. Excessive beam densities increase the production of charge exchange ions that increase grid erosion. Also, when we can maintain constant spacing, we can design larger grid diameters without increasing the likelihood that thermal expansion will adversely affect performance. Large grid diameters translate into higher efficiency, higher thrust-to-weight, and improved reliability.

Carbon-carbon grids also are more resistant to ion erosion than the materials used today to make grids, such as molybdenum. Space applications require that such grids have a lifetime on the order of 10,000 hours. Carbon-carbon grids formed in accordance with the present invention show potential to exceed such lifetimes without restrictions imposed on the thruster operating conditions (specifically, without limiting the beam density for the purpose of reducing the erosion rate).

Our experimental results confirm the benefits of carbon-carbon grids in ion optics sets. As described in Meserole, *Measurement of Relative Erosion Rates of Carbon-Carbon and MolRbdenum Ion Optics,* 30th AIAA/ASE/SAE/ASEE Joint Prop. Conf., Jun. 27–29, 1994, pp. 1–9, we achieved a reduction in the erosion rate using carbon-carbon grids in place of molybdenum. The benefit was 15 times slower erosion, providing an order of magnitude longer life. We made 10 cm diameter, circular, planar grids from 14 cm square flat panel carbon-carbon sheets 0.9 mm thick. The sheets had three plies of 5-harness satin weave fabric laid up in a (0,45,0) orientation wherein pure carbon suffused into the pitch-based fibers (modulus 7.2×11" Pa) using chemical vapor infiltration. The grid panels had a range for the coefficient of thermal expansion (CTE) of from $-2.0\times10^{-6}$/K at 295 K to about $+1.0\times10^{-6}$/K at 675 K, which is the CTE performance we prefer when we say that the CTE is essentially zero. With grids of this type, we expect that we could repeatedly reduce the erosion rate 10–15 X over that of molybdenum.

In accordance with the present invention, the screen and accelerator grids can be combined in a conventional manner to provide an ion optics set 8 (FIG. 2) for use in the ion thruster 1 or other ion beam sources. When the carbon-carbon composite screen and accelerator grids are used in an ion optics set 8, we use grid spacings of approximately 0.2 mm to 0.5 mm, but wider spacing is possible. The narrow grid spacing described above is achievable with the carbon-carbon grids because the thermal-mechanical stability of the carbon-carbon composite and the stiffness of the grids allows the screen and accelerator grids to be spaced closer together than conventional grids. The use of carbon-carbon composites for the mounting rings further contributes to the thermal-mechanical stability of the ion optics, hence, the ability of the grids to be closely spaced. Closer spacing increases the field strength between the grids which increases the maximum achievable beam density.

Generally, the fabrication of the grids includes selecting a high-modulus carbon fiber, an appropriate lay-up pattern, a suitable means of densification, and a method for making apertures of the desired shape and arrangement. Minimizing the thicknesses of the screen grid and accelerator grid, subject to structural and erosion constraints, is also an important design consideration.

We can lay up the carbon fibers on a solid substrate in any of the described patterns. The substrate that is chosen should be compatible with the subsequent infiltrating step. For example, a flat carbon block may be suitable as a base for laying up the fibers. The carbon fibers should be laid up in as dense an arrangement as possible given the desired thickness of the particular grid. As grids are made thinner, care must be taken that they do not become too flexible. With respect to the particular form of the fiber chosen, we prefer tapes of fibers or tows over woven fabrics since woven fabrics tend to introduce added thickness at the points of the overlapping weaves and the curing of the fibers in the weave reduces the effective grid stiffness. The fibers may comprise approximately 50–65 volume percent of the overall grid. Generally, the higher the volume percent fibers, the stiffer the grid.

We densify the lay-up of fibers by introducing the carbon matrix using techniques such as pitch infiltration, resin infiltration, or chemical vapor infiltration. We like to use pitch infiltration to fill the larger internal voids and chemical vapor infiltration for the smaller voids. Since neither densification method provides a void-free body, to improve the erosion resistance, internal voids exposed when the apertures are cut should be filled by chemical vapor infiltration. The densification steps preferably provide a carbon-carbon composite having a density greater than 1.9 g/cm$^3$. Accordingly, when the grid comprises about 50 volume percent fibers, the carbon matrix will comprise approximately 50 volume percent of the grid. That is, the matrix is free of porosity.

We can cut the apertures in the grids by several different methods. For example, for round apertures, you can use mechanical drilling, laser cutting, ultrasonic milling, water jet cutting, or electron discharge machining.

For some applications, you may prefer to employ a technique providing uniformly tapered apertures which can provide a wider range of operating conditions without the beam impinging upon the side walls. As a result, we can use thicker grids to achieve the desired grid stiffness, without incurring a performance penalty of increase grid aperture erosion. Removing the "sharp" perimeter of the apertures also reduces erosion effects at these edges.

Alternatively, we can form the apertures by providing a pattern of pegs or other inserts around which the carbon fibers are laid up and around which the carbon infiltration of the array is carried out. In this manner, we preform the apertures rather than requiring subsequent cutting after infiltration. Preformed apertures may require trimming.

EXAMPLE

We made a 10-cm diameter, flat, circular screen grid and a 10-cm diameter, flat, circular accelerator grid from two 14-cm square carbon-carbon panels we obtained from B. F. Goodrich of Sante Fe Springs, Calif. The panels consisted of three plys of carbon fiber fabric densified by chemical vapor infiltration. The fibers making up the fabric had an elastic modulus of about 105 million psi. The infiltrated panels were 0.8 mm thick and were machined to include 1,615 apertures in a regular array over the surface with uniform spacing. In the accelerator grid, each aperture had a diameter of 1.09 ram, and 1.83 mm in diameter in the screen grid. The screen grid had an open area fraction of 0.59 and the accelerator grid, 0.21. Hole spacing between the apertures in both grids was 2.29 mm and the hole profile was a tapered 6° cut, which was a result of the particular laser cutting operation used to produce the apertures. We tested this carbon-carbon grid set for voltage stand-off capability, maximum perveance condition, electron backstreaming limit and defocusing limit.

No special surface preparation, either cleaning or smoothing, was done prior to testing. The laser machining process left a soot-like discoloration on the laser entry side of each grid. The surface roughness due to the fiber weave was about 0.05 mm. When mounted, these grids were measured to be flat to within 0.025 mm.

Optic tests were conducted using a 15-cm ion source produced by Ion Tech., Inc. of Fort Collins, Colo. We used an adapter to mask down the 15-cm source to 10-cm and to accept a separate conventional molybdenum grid mount that was used to mount the carbon-carbon grids.

The ion source used tungsten filaments for both the cathode and the neutralizer. Variable alternating current sources (variacs) drove the cathode and neutralizer. We isolated the cathode from its variac using an isolation transformer. The beam supply was rated at 3,000 volts and I amp and was referenced to facility ground. The discharge supply floated at beam potential with its positive terminal connected to the positive terminal of the beam supply and its negative terminal connected to the mid-point of the secondary winding on the cathode isolation transformer. The discharge supply was rated at 200 volts and 17 amps. The accelerator supply was rated to 600 volts and 1.5 amps. The tests were conducted using xenon as the propellant, although we could also use other inert gases (such as argon and krypton), or gases of other elements or molecules (such as mercury, or carbon-60).

Before operating the grids on the thruster, we conducted voltage standoff tests. The optics set was mounted to the molybdenum grid mount, gapped to 0.58 mm and then tested until voltage breakdown occurred in both air and vacuum using a high voltage, variable DC power supply. We placed a 100K ohm power resistor in series with the high voltage power supply to limit the current when arcing occurred. First, in air at ambient conditions, we increased the voltage across the grids slowly. We observed arcing initially as we increased the voltage to about 1,000 volts, but by pausing at each occurrence of arcing, the rate of arcing decreased, and eventually stopped. We increased the voltage to 2,500 volts. After some initial arcing, we held the voltage at 2,500 volts for several minutes until we observed no further arcing. The voltage gradient at that point was 4,300 volts per mm based upon the preset gap measurement. Inspection of the grids under a microscope following the test showed that the arcing had no operating effect on the grids, other than to produce some slight, localized surface discoloration.

We repeated the procedure in a vacuum chamber pumped down to $1\times10^{-5}$ torr, and did not observe arcing until 3,500 volts. At 3,500 volts, we observed a small, steady current of about 0.5 milliamps on the power supply analog current meter. At 3,750 volts, arcing began, but it subsided with time. Eventually, we reached 5,000 volts with only occasional arcing, but recorded a steady current of 1 milliamp. At 5,250 volts, we observed arcing. At 5,250 volts, the voltage gradient was 9,050 V/mm based upon the preset gap measuement. We estimate maximum voltage gradients of 6,420 V/mm during operation at 0.2 mm spacing for the carbon-carbon grids.

We selected three grid-to-grid gaps of 0.2 mm, 0.3 mm, and 0.5 mm at which to operate the thruster. These gaps provided effective acceleration lengths of 1.35 mm, 1.42 mm, and 1.58 mm.

Prior to starting the thruster for each run, the chamber background pressure was recorded while xenon flowed at the rate desired for that run. The thruster was then started and allowed to warm up for at least 30 minutes prior to data acquisition. For all runs, the initial run conditions were:

1.) the propellant utilization efficiency $\eta_p$) was set to approximately 75%, determined by the ratio of beam current to propellant flow rate, where flow rate was converted to an equivalent current flow using 1 amp equal to 13.95 standard cubic centimeters per minute for singly ionized atoms;

2.) the discharge voltage $V_d$ was set to 35 volts, which was less than or equal to 10% of the total accelerating voltage $V_t$. The total accelerating voltage is given by $V_t=V_b+|V_a|$ where $V_b$ is the beam (and also the net accelerating voltage and $|V_a|$ is the absolute value of the accelerator grid voltage;

3.) the net to total voltage ratio R was set to 0.8, where $R=V_b/V_t$; and

4.) the total voltage was set high enough to preclude direct ion impingement (by choosing a $V_t$ such that further increases in $V_t$ at a fixed R did not reduce accelerator grid impingement current).

Figure 12:
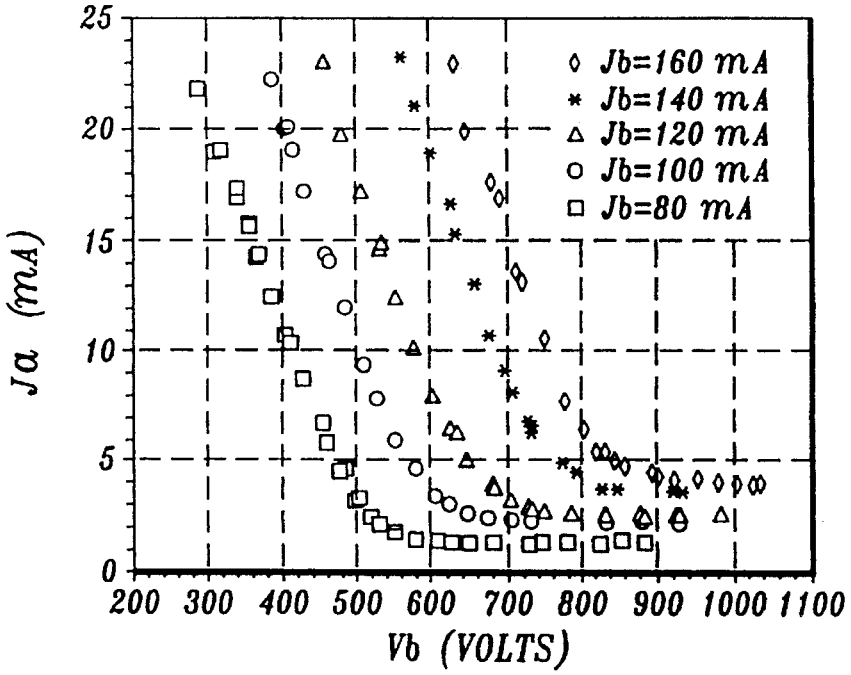
FIG. 12 is a typical graph of accelerator grid impingement current ($J_a$) as a function of beam voltage ($V_b$) for an ion optics set formed in accordance with the present invention.

Perveance expresses total current in terms of applied voltage. For a fixed beam current, the maximum perveance condition of an ion optics set occurs at the minimum total voltage ($V_t$) prior to the onset of direct ion impingement. For the carbon-carbon grids, we measured accelerator grid impingement current as a function of decreasing beam voltage to identify the minimum total voltage prior to direct ion impingement. We made measurements for each of five beam current ($J_b$) levels from 80 milliamps to 160 milliamps, and for an acceleration length of 1.35 mm. We held beam current constant by adjusting the discharge current as necessary in response to changes in the beam voltage. Accelerator grid voltage was fixed for each run. FIG. 12 shows a representative plot of accelerator grid impingement current ($J_a$) as a function of beam voltage ($V_b$) for the carbon-carbon optics.

Electron backstreaming occurs when the accelerator grid voltage is no longer sufficient to shield external electrons from the positive potential of the discharge chamber. Electrons are then free to flow from the external environment into the discharge chamber.

Figure 13:
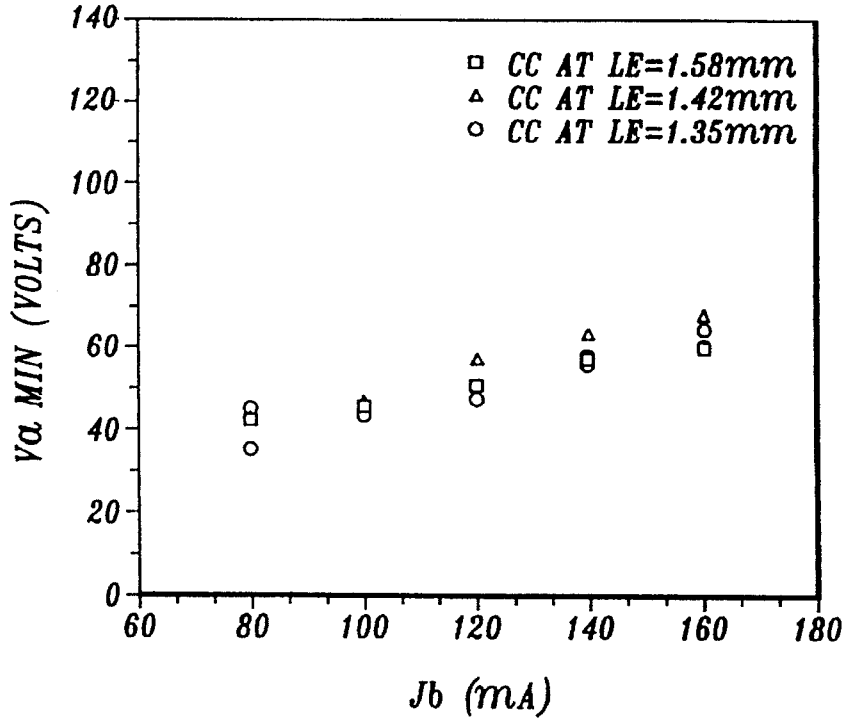
FIG. 13 is a typical graph of accelerator grid voltage ($V_a$) as a function of beam current ($J_b$) for an ion optics set formed in accordance with the present invention.

After completing each data run for determining the maximum perveance condition, we reestablished the initial conditions and then measured beam current ($J_b$) as a function of decreasing accelerator grid voltage ($V_a$) for each of the effective acceleration lengths. We slowly reduced the accelerator grid voltage as we monitored the analog current meter on the beam supply. As the accelerator grid voltage fell below the electron backstreaming limit, we observed a rapid increase in beam current. The accelerator grid voltage at which this beam current occurred was recorded as the electron backstreaming limit. FIG. 13 represents plots of the electron backstreaming limit for each run.

Figure 14:
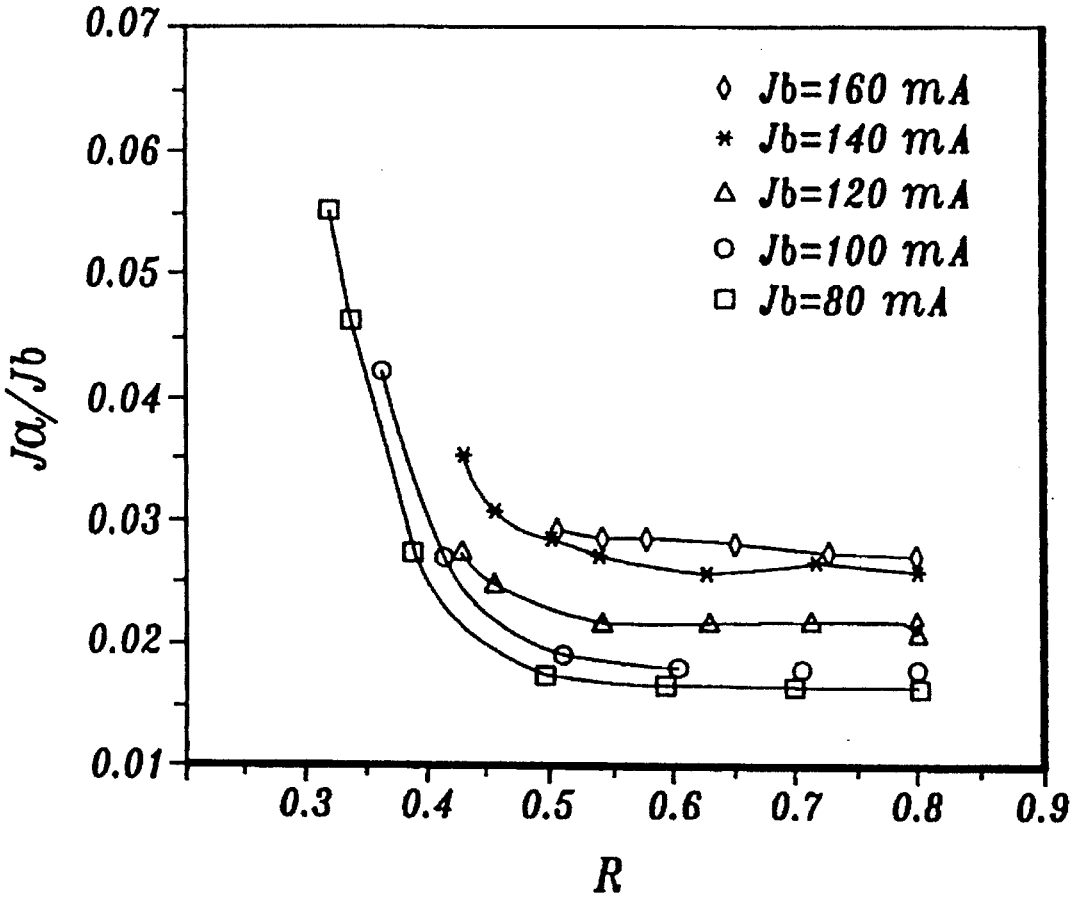
FIG. 14 is a typical graph of the ratio of accelerator grid impingement current ($J_a$) to beam current ($J_b$) as a function of net-to-total voltage ratio ($R=V_b/V_t$) for an ion optics set formed in accordance with the present invention.

After completing each data run for determining the electron backstreaming limit, we reestablished the initial run conditions. For an effective acceleration length of 1.42 mm, we measured accelerator grid impingement current as a function of net-to-total voltage ratio (R) while holding total voltage ($V_t$) constant. This determined the minimum R prior to the onset of direct ion impingement. For the selected total voltage, R was adjusted down from an initial value of 0.8 by decreasing the beam voltage, then increasing the accelerator grid voltage by the same amount, thereby lowering the beam (net) voltage while maintaining a fixed total voltage. At each step, we recorded accelerator grid impingement current. As the defocusing limit was approached, the accelerator grid impingement current increased from the background level. We identified the value of R at which the accelerator grid current first increased above the background level as the defocusing limit for each run condition. FIG. 14 shows the ratio of accelerator grid impingement current ($J_a$) to beam current ($J_b$) plotted as a function of R. For the carbon-carbon optics at an effective acceleration length of 1.42 millimeters, the defocusing limit occurred for R values between 0.4 and 0.5.

During these tests, we did not observe buckling or breaking of the ion optics. Accordingly, our fiat carbon-carbon ion optics have sufficient thermomechanical stability to operate with grid spacings on the order of 0.2 mm.

While we have described preferred embodiments, those skilled in the art will readily recognize alterations, variations, and modifications which might be made without departing from the inventive concept. Therefore, interpret the claims liberally with the support of the full range of equivalents known to those of ordinary skill based upon this description. The examples are given to illustrate the invention and are not intended to limit it. Accordingly, limit the claims only as necessary in view of the pertinent prior art.

We claim:

1. A grid element, for use in an ion optics set of an ion beam source, comprising:

a body of substantially uniform thickness in the range of 0.3–1.0 mm adapted for use in the ion optics set and including an array of apertures passing therethrough, said body comprising a carbon-carbon composite of carbon fibers and a carbon matrix, the areas of said body and said apertures being related by a predetermined open area fraction in the range of 0.2–0.8, the composite having a coefficient of thermal expansion essentially equal to zero.

2. The grid element of claim 1, wherein said carbon fibers have an elastic modulus ranging between about $7\times10^5$ MPa to about $1\times10^6$ MPa.

3. The grid element of claim 1, wherein about half the carbon fibers are oriented parallel to a first axis and the remaining carbon fibers are arranged parallel to a second axis offset from the first axis by about 90 degrees.

4. The grid element of claim 3, wherein the apertures have a tapered profile from inlet to exit.

5. The grid of claim 1 being a screen grid having an open area fraction in the range of 0.65–0.80.

6. The grid of claim 1 being an accelerator grid having an open fraction in the range of 0.20–0.30.

7. An ion optics set comprising a carbon-carbon screen grid spaced on one side of a carbon-carbon accelerator grid about 0.2–0.5 mm from the accelerator grid, both grids being defined in accordance with claim 1.

8. The ion optics set of claim 14 further comprising a decelerator grid spaced about 0.2–0.5 mm from the accelerator grid on the other side of the accelerator grid from the screen grid.

* * * * *

UNITED STATES PATENT AND TRADEMARK OFFICE

CERTIFICATE OF CORRECTION

PATENT NO. : 5,548,953

DATED : August 27, 1996

INVENTOR(S) : Daniel E. HEDGES et al.

It is certified that error appears in the above-identified patent and that said Letters Patent is hereby corrected as shown below:

Column 12, Line 61, "8. The ion optics set of claim 14"

should read - - 8. The ion optics set of claim 7 - -

Signed and Sealed this

Fifth Day of November, 1996

Bruce Lehman

*Attest:*

BRUCE LEHMAN

*Attesting Officer*

*Commissioner of Patents and Trademarks*